US007475678B2

(12) United States Patent
Douyama et al.

(10) Patent No.: US 7,475,678 B2
(45) Date of Patent: Jan. 13, 2009

(54) INTEGRATED FUEL DELIVERY SYSTEM

(75) Inventors: Yoshiaki Douyama, Shiroishi (JP); Kerry E. Grifka, Ubly, MI (US); Kevin L. Israelson, Cass City, MI (US); Ronald H. Roche, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 203 days.

(21) Appl. No.: 11/082,340

(22) Filed: Mar. 17, 2005

(65) Prior Publication Data

US 2006/0207573 A1 Sep. 21, 2006

(51) Int. Cl.
*F02M 37/04* (2006.01)

(52) U.S. Cl. ..... 123/509

(58) Field of Classification Search ..... 123/509, 123/510, 514, 506; 137/115.27, 509, 510; 210/446, 130, 196

See application file for complete search history.

(56) References Cited

U.S. PATENT DOCUMENTS

| | | | | |
|---|---|---|---|---|
| 5,078,167 | A * | 1/1992 | Brandt et al. | 137/549 |
| 5,392,750 | A * | 2/1995 | Laue et al. | 123/509 |
| 5,647,330 | A * | 7/1997 | Sawert et al. | 123/509 |
| 5,649,514 | A * | 7/1997 | Okada et al. | 123/514 |
| 6,247,486 | B1 * | 6/2001 | Schwegler et al. | 137/115.27 |
| 6,311,725 | B1 * | 11/2001 | Hamada et al. | 137/565.13 |
| 6,589,419 | B1 * | 7/2003 | Brunel et al. | 210/232 |
| 6,679,229 | B2 * | 1/2004 | Wada et al. | 123/516 |
| 6,746,603 | B2 * | 6/2004 | Harvey et al. | 210/234 |
| 2003/0127075 | A1 * | 7/2003 | Braun et al. | 123/510 |
| 2006/0070941 | A1 * | 4/2006 | Cline et al. | 210/416.4 |

* cited by examiner

*Primary Examiner*—Thomas N Moulis
(74) *Attorney, Agent, or Firm*—Reising, Ethington, Barnes, Kisselle, P.C.

(57) ABSTRACT

A fuel delivery system for a combustion engine has a fuel tank which defines an access hole preferably communicating through either the top wall or bottom wall of the tank. An associated top or bottom flange, both having a fuel channel for flowing fuel out of the tank, sealably covers the access hole. A fuel pump module is located in the fuel chamber of the tank and has a universal, structural, pod which engages either the top or bottom flange while preferably maintaining an axial upright position. The pod defines an axially extending first bore for housing a fuel pump and preferably an electric pump motor and a second bore defined by a cylindrical inner face and spaced radially outward from the first chamber for housing a reversible filter cartridge of the module. The pod also has a fuel discharge nozzle which generally defines a counter bore that communicates axially with the second bore. Fuel flows into the pump through an inlet defined by the pod and pressurized fuel flows from the pump and into the second bore via a fuel passage preferably defined by the pod. The filter cartridge preferably has a filter element generally spaced from the pod within the second bore for filtration efficiency by a primary end retainer and an opposite secondary end retainer. The end retainers generally seal to the pod within the second bore thus flowing all of the pressurized fuel from the fuel passage and through the filter element before being discharged from the second bore as supply fuel and/or bypass fuel. Preferably, filtered fuel flows through the primary end retainer as system supply fuel to a combustion engine and the remaining filtered fuel flows through the secondary end retainer as bypass fuel back into the fuel tank chamber.

17 Claims, 5 Drawing Sheets

INTEGRATED FUEL DELIVERY SYSTEM

FIELD OF THE INVENTION

This invention relates generally to an integrated fuel delivery system for a combustion engine, and more particularly to a versatile fuel pump module of the system having a universal structural pod for supporting a fuel pump, motor, and reversible filter cartridge.

BACKGROUND OF THE INVENTION

Automotive fuel pump modules commonly having a fuel pump, pump motor, filters, and a pressure regulator are known to be located inside a fuel tank. The modules are typically inserted through an access hole of the tank and supported therein by a flange which also sealably covers the access hole. Depending upon the fuel delivery system application, known modules differ widely from one another. For instance, a majority of modules are known to be inserted through the top of the tank thus being attached to a top flange, and a limited few are inserted through the tank bottom thus being attached to a bottom flange and typically known in motorcycle fuel tank applications such as that disclosed in U.S. patent application Ser. No. 10/634,258, filed Aug. 5, 2003, assigned to Walbro Engine Management, LLC, and incorporated herein by reference.

Unfortunately, in such differing applications, the module and especially the supporting structure of the module differ. For instance, the supporting structure design differs widely depending on whether the flange is mounted to the top or bottom of the tank. Yet further, differences in the support structure can lead to design differences in the outlet filter and the pressure regulator which are known to be separate from one-another and thus individually supported by the module structure. The multitude of differing module components required for differing system applications is costly in design, manufacturing and generally complicates maintenance and repair tasks. Furthermore, the separate placement of each module component requires excessive tubes and fittings to flow the fuel, and increases the overall size of the module which is undesirable in small fuel tanks or where size of the access hole must be minimized for structural integrity of the tank and to minimize fuel vapor permeation through the tank.

SUMMARY OF THE INVENTION

A fuel delivery system for a combustion engine has a fuel tank which has a covered access hole preferably communicating through either the top wall or the bottom wall of the tank. A versatile fuel pump module has a universal structural pod in the fuel tank which preferably extends substantially vertically between the top and bottom walls in a consistent upright position and is used in differing fuel tank applications regardless of whether the access hole communicates through the top wall or bottom wall. The pod houses a fuel pump in a first bore and a reversible filter cartridge, preferably having a fuel filter element and an integrated pressure regulator, in a second bore. Fuel enters the fuel pump through a bottom port of the pod and pressurized fuel exits the pump and flows through a fuel passage of the pod into the second bore where it flows through the reversible cartridge filter and a pressure regulator before the fuel is expelled from the module as supply and bypass fuel through respective ports generally of the second bore. Both the fuel pump and the reversible cartridge are utilized in conjunction with the universal pod regardless of the access hole location in the fuel tank.

For applications or aspects where the access hole is located in the top wall of the fuel tank, the fuel pump module utilizes a top flange for covering the hole. The, top flange has a fuel supply channel for flowing pressurized fuel out of the tank from the upper port of the second bore preferably via a flexible tube coupled between the pod and the top flange. The cartridge is preferably retained in the second bore by a bottom cover which fastens to the pod and generally defines the lower port. Excess or bypass fuel controlled or produced by the pressure regulator flows through the lower port and back into the fuel tank chamber. For applications or aspects where the access hole is located in the bottom wall of the fuel tank, the fuel pump module utilizes a bottom flange, preferably identical to the top flange, for covering the bottom access hole and for flowing pressurized fuel through the supply channel and out of the tank.

In applications where the cartridge preferably has an integrated pressure regulator, the orientation of the cartridge is reversed or flipped over when compared to the top flange application, thus flowing supply fuel generally downward through the lower port and fuel channel, and flowing bypass fuel generally upward through the upper port and back into the fuel tank chamber. For the bottom flange application, the bottom cover is preferably not utilized and instead, the bottom flange fastens to the pod in preferably the same manner as the bottom cover does for the top flange application.

Objects, features and advantages of this invention is a fuel pump module which is more robust, flexible in application, cost effective, reduces the number of parts required for varying applications and is capable of utilizing low cost pressure regulators. Moreover, the module is capable of being disassembled for easy maintenance, is rugged, compact, durable, of relatively simple design, economical manufacture, and in service has a long useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 2:
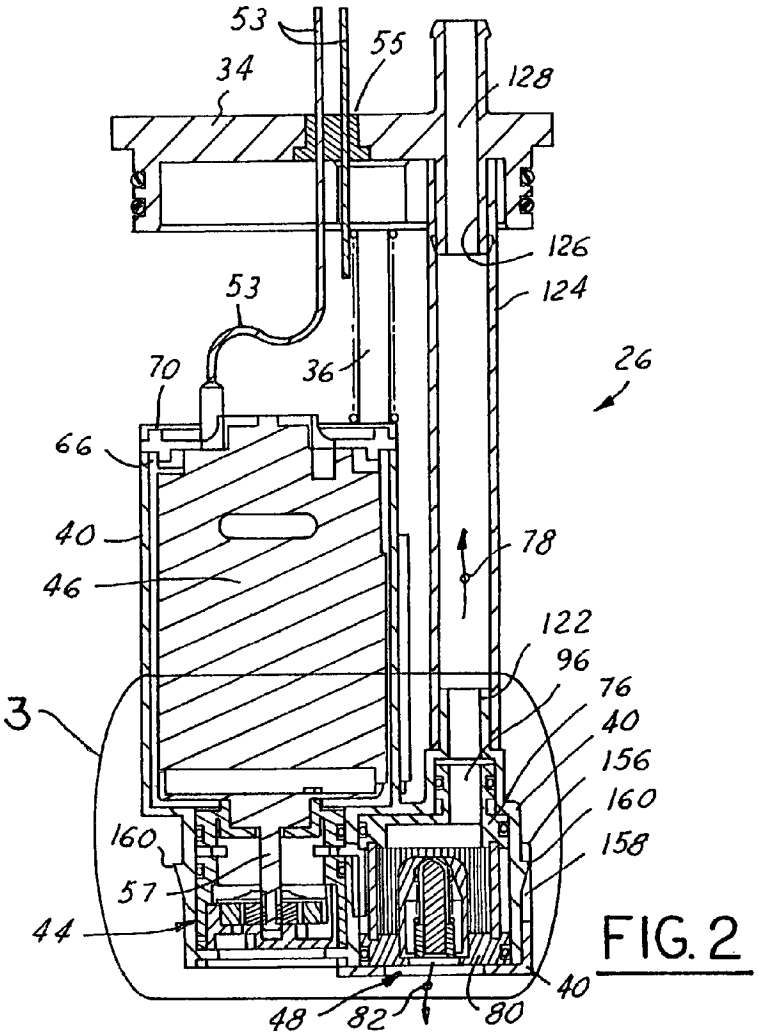
FIG. 2 is a cross section of the fuel pump module taken along line 2-2 of FIG. 1.

Referring in more detail to the drawings, FIGS. 1-7 illustrate a fuel delivery system 20 for a combustion engine having a fuel tank 22 defining a fuel chamber 24 and a versatile fuel pump module 26 located in the chamber. Aspects of the fuel pump module 26 are reversible, interchangeable, and/or universal depending upon whether an access hole 28 of the fuel tank 22 is located in a top or bottom wall 30, 32 of the tank. For the sake of description, the aspects relative to a fuel tank 22 having a top access hole 28, or top mounted version, will first be described.

Figure 1:
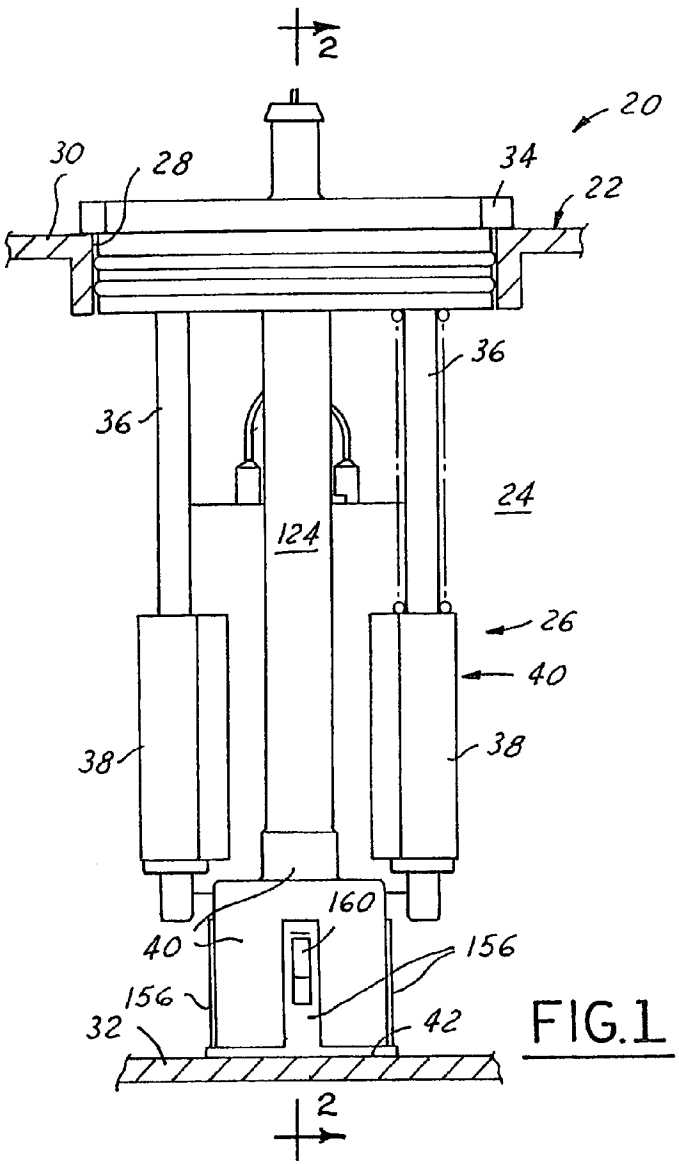
FIG. 1 is a side view of an integrated fuel delivery system having a fuel pump module utilized in a fuel tank having a top access hole and embodying the present invention.
Figure 5:
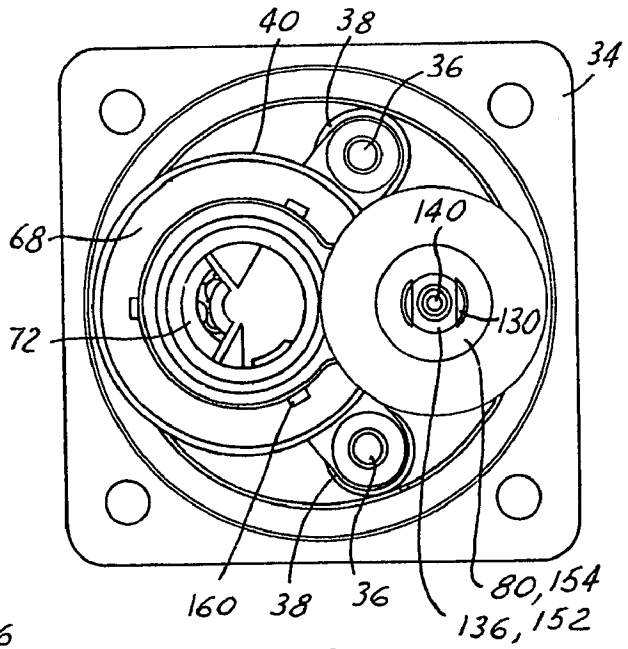
FIG. 5 is a bottom end view of the fuel pump module taken along line 5-5 of FIG. 3.
Figure 3:
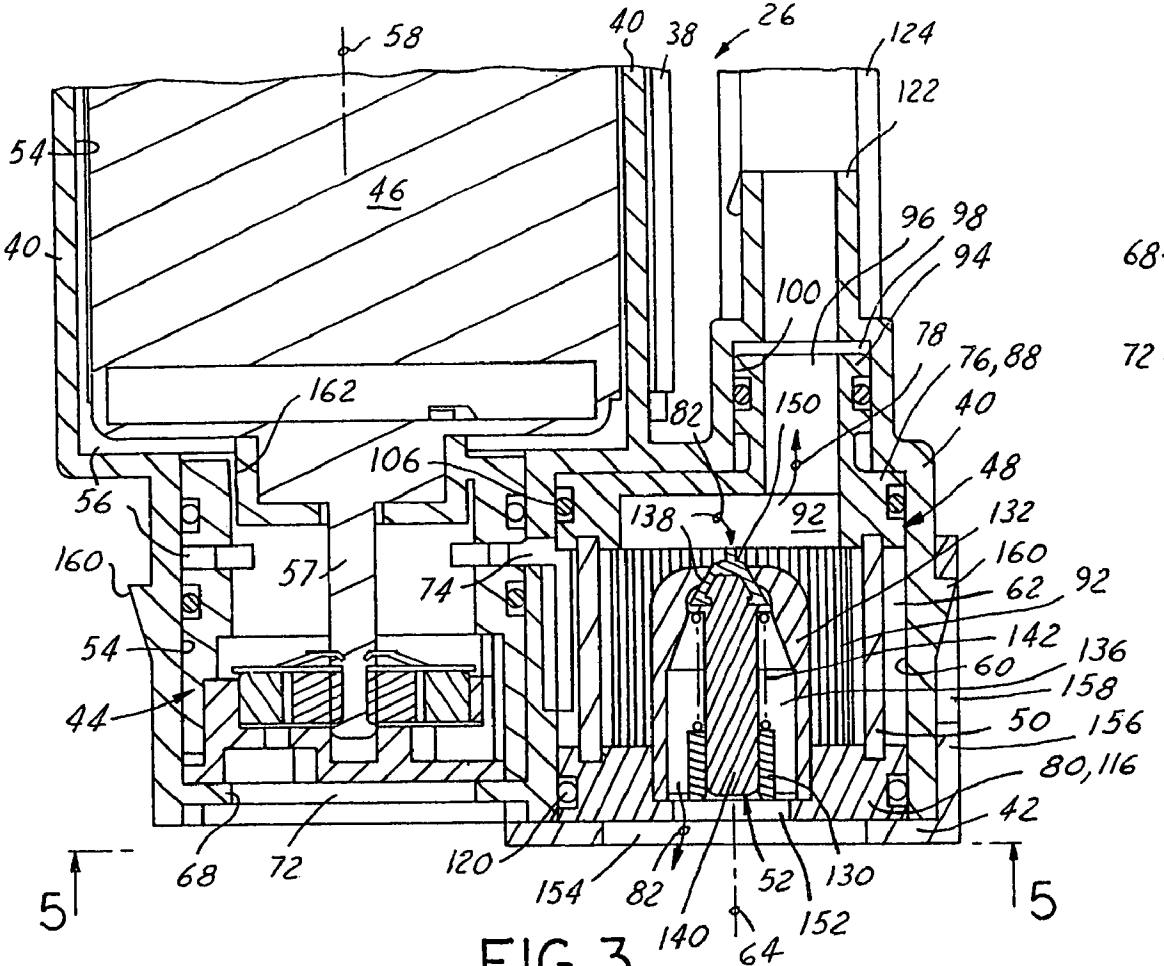
FIG. 3 is a partial enlarged cross section of the fuel pump module taken from circle 3 of FIG. 2.

As best illustrated in FIGS. 1-3, the access hole 28 located in the top wall 30 of the fuel tank 22 is covered sealably by a top flange 34. Suspended rigidly from the flange 34 in the chamber 24 of the tank 22 are two spring loaded shocks or vertical displacement struts 36 which fit slidably into strut guides 38 of a universal structural pod 40 to yieldably support the pod 40 of the fuel pump module 26 so that a bottom or bottom cover plate 42 of the pod is generally located and held against the bottom wall 32 of the tank 22 even if the tank walls should slightly flex, expand, or contract. The pod 40 houses and supports numerous components including a fuel pump 44, an electric motor 46 coupled to the pump, and a reversible filter cartridge 48 having a filter element 50 and an integrated pressure regulator 52. Fuel flows generally between the components via the pod thus eliminating the need for conventional hoses, tubes and fittings. Power leads or wires 53 are routed from the motor 46 and through a sealing grommet 55 of the top flange 34.

The pod 40 carries an inner cylindrical first surface 54 defining a first bore 56 having a central axis 58 extending substantially vertically, and an inner cylindrical second surface 60 defining a second bore 62 spaced radially outward from the first bore 56 and having a central axis 64 disposed substantially parallel to the central axis 58 of the first bore 56. The pump and motor 44, 46 are assembled in the first bore 56 and the filter cartridge 48 is assembled in the second bore 62.

During manufacture, components of the fuel pump 44 are preferably assembled into the first bore 56 through an open top end 66 and are generally nested against a continuous bottom shoulder 68 projecting radially and unitarily inward from the first cylindrical surface 54. After the fuel pump 44 is assembled, the pump motor 46 which has a stator encircling an armature with a drive shaft 57 journaled for rotation by a pair of bearings is inserted into the first bore 56 from above and coupled mechanically to the pump 44. The open end 66 is then sealed-off by a cap 70 which preferably carries one of the bearings. At least one electrical lead 53 extends through the end cap 70. When operating, fuel enters the pump 44 through a bottom port 72 generally defined by the shoulder 68 of the pod 40 and pressurized fuel exits the pump 44 and flows into the second bore 62 via a fuel passage 74 defined by the pod 40 and communicating through the first and second surfaces 54, 60.

Figure 4:
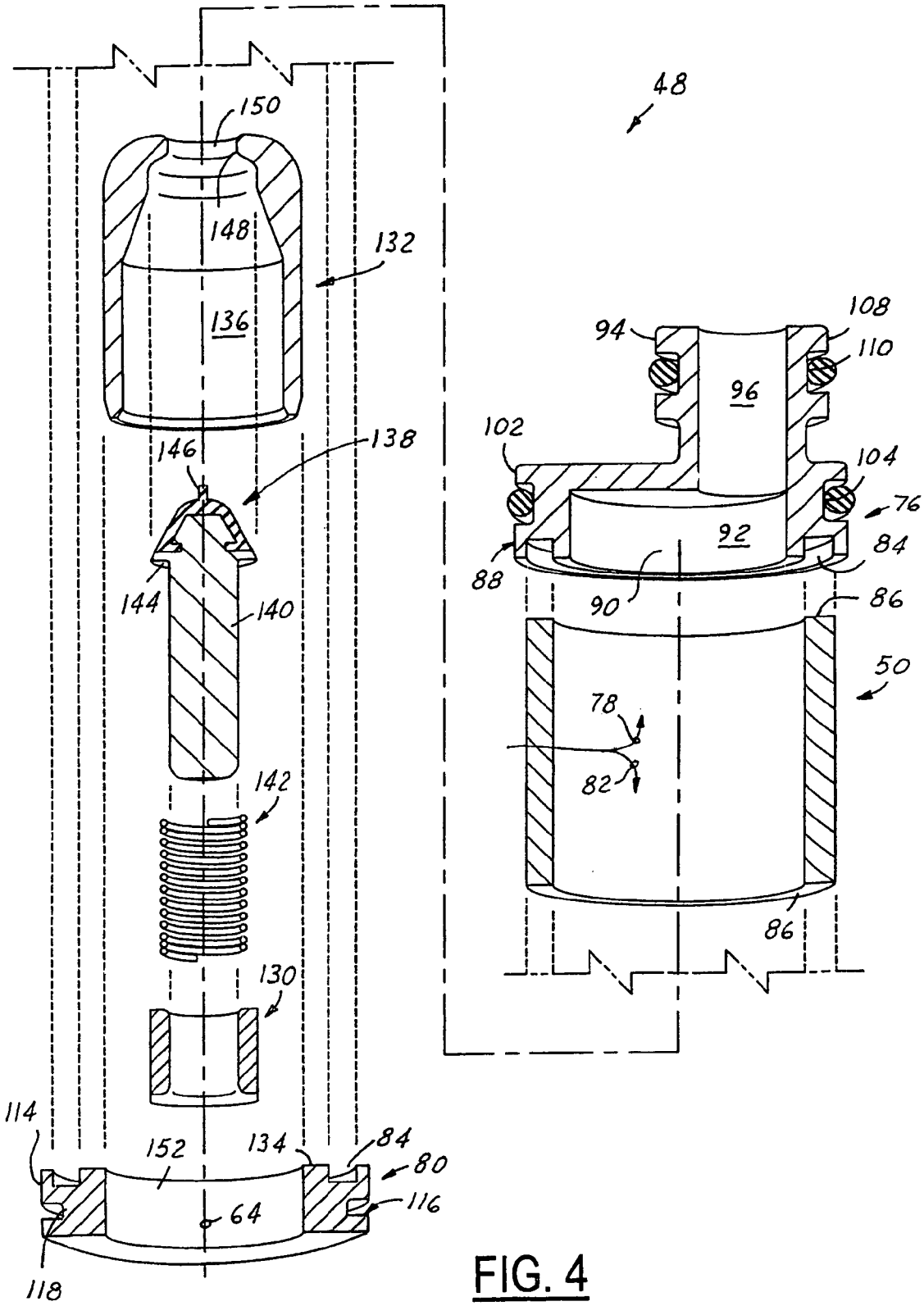
FIG. 4 is a cross-sectioned, exploded, perspective view of a reversible filter cartridge of the fuel pump module.

As best illustrated in FIGS. 2-4, the reversible filter cartridge 48 is preferably pre-assembled with the integral fuel pressure regulator 52 located radially inward from the cylindrical fuel filter element 50. The filter element 50 is located axially between an inverted funnel-like primary end retainer 76 for flowing the engine supply fuel identified by arrow 78 and a secondary end retainer 80 of the cartridge 48 for flowing the bypass fuel identified by arrow 82. Each disc-like retainer 76, 80 defines a circular groove 84 (as best shown in FIG. 4) which oppose one-another in an axial direction for seating opposite ends 86 of the cylindrical filter element 50 and spacing the element radially inward from the second cylindrical surface 60 to maximize filtration efficiency and filter surface area. This construction also prevents shifting of the filter element 50 within the second bore 62 and prevents bypassing of the fuel around the filter element 50.

The primary end retainer 76 has an inverted bowl-like base portion 88 which carries a cylindrical inward face 90 that defines in-part a fuel cavity 92 held at system operating pressure by the pressure regulator 52, and a collar portion 94 which projects upward from the base portion 88 and defines a supply fuel outlet channel 96 that communicates axially with the cavity 92. The collar portion 94 projects into a counter bore 98 defined by a cylindrical third surface 100 carried by the pod 40. An outer cylindrical face 102 of the base portion 88 has a circumferentially continuous groove 104 which seats a resilient seal or O-ring 106 that seals to the second surface 60 of the second bore 62. An outer cylindrical face 108 of the collar portion 94 also has a circumferentially continuous groove 110 which seats an O-ring 112 that seals to the third surface 100 of the counter bore 98, and likewise, an outer cylindrical face 114 of a base segment 116 of the secondary end retainer 80 has a circumferentially continuous groove 118 which seats an O-ring 120 that seals to the second surface 60 of the second bore 62. All three O-rings 106, 112, 120 and the seating arrangement of the filter element 50 to the retainers 76, 80 assure that all of the fuel flowing from the fuel passage 74 is filtered before entering the pressurized fuel cavity 92.

After filtration, fuel which enters the cavity 92 flows to the engine through the fuel outlet channel 96 of the collar portion 94, through an upward projecting barbed nipple or filter 122 of the pod 40 and into a flexible tube 124 press fitted to the nipple 122 and extending upward to couple to a similar nipple 126 projecting downward from the top flange 34 (as best shown in FIG. 2). From the flexible tube 124, the fuel flows out of the tank via the flange channel 128. When system fuel pressure is exceeded by the pump 44, the pressure regulator 52 will open allowing bypass fuel 82 to flow from the pressure cavity 92 and through the secondary retainer 80 back to the tank chamber 24.

As best illustrated in FIG. 4, unlike the primary end retainer 76 which is preferably unitary or molded as one piece, the secondary retainer 80 has a valve head guide 130 and a dome 132 press fitted into the base 116 during pre-assembly of the pressure regulator 52. When assembled, the dome 132 projects axially and concentrically upward from the base 116 and is spaced radially inward from the filter element 50. The pressurized fuel cavity 92 is thus generally defined axially between the primary end retainer 76 and an annular face 134 of the base 116 of the secondary end retainer 80 spanning radially between the groove 84 and the dome 132. The cavity 92 is generally defined radially between the inner dome 132 and the outer filter element 50. The dome 132 inwardly defines an inner valve chamber 136 of the pressure regulator 52 which contains an enlarged valve head 138 attached to a downward projecting shaft or shank 140 and is biased closed by a spring 142. The guide 130 is also located concentrically in the valve chamber 136 and generally projects radially inward from the base 116. The shaft 140 extends concentrically through the compression spring 142 which seats axially between the guide 130 and an annular shoulder 144 carried by the enlarged valve head 138. A resilient conical tip 146 of the valve head 138 faces opposite the shoulder 144 and resiliently seals against a valve seat 148 carried by the dome 132 and which generally defines an aperture 150 which communicates between the cavity 92 at system pressure and the valve chamber 136 at tank pressure.

When fuel system pressure is exceeded, the spring 142 compresses as the valve head 138 moves downward and axially away from the seat 148. Bypass fuel 82 flows through the aperture 150 and downward through the valve chamber 136 and exits the second bore 62 through the hole 152 of the base 116 and through a slightly larger hole 154 of the cover 42.

During manufacture, at least one and preferably three upward projecting flex arms 156 of the cover 42 snap fit to the pod 40 to hold the cartridge 48 within the second bore 62 (as best shown in FIGS. 1 and 3). Preferably, the arms 156 each have a slot 158 which receives a ramped tab 160 projecting outward from the pod 40, thus locking the cover 42 in-place. As best illustrated in FIG. 3, the pod 40 carries a cooling vent 162 for limited bypass flow of fuel from the pump 44 and between the stator and armature of the motor 46 for stratified fuel residence to improve efficiency and reduce motor brush/commutator deposits.

Figure 6:
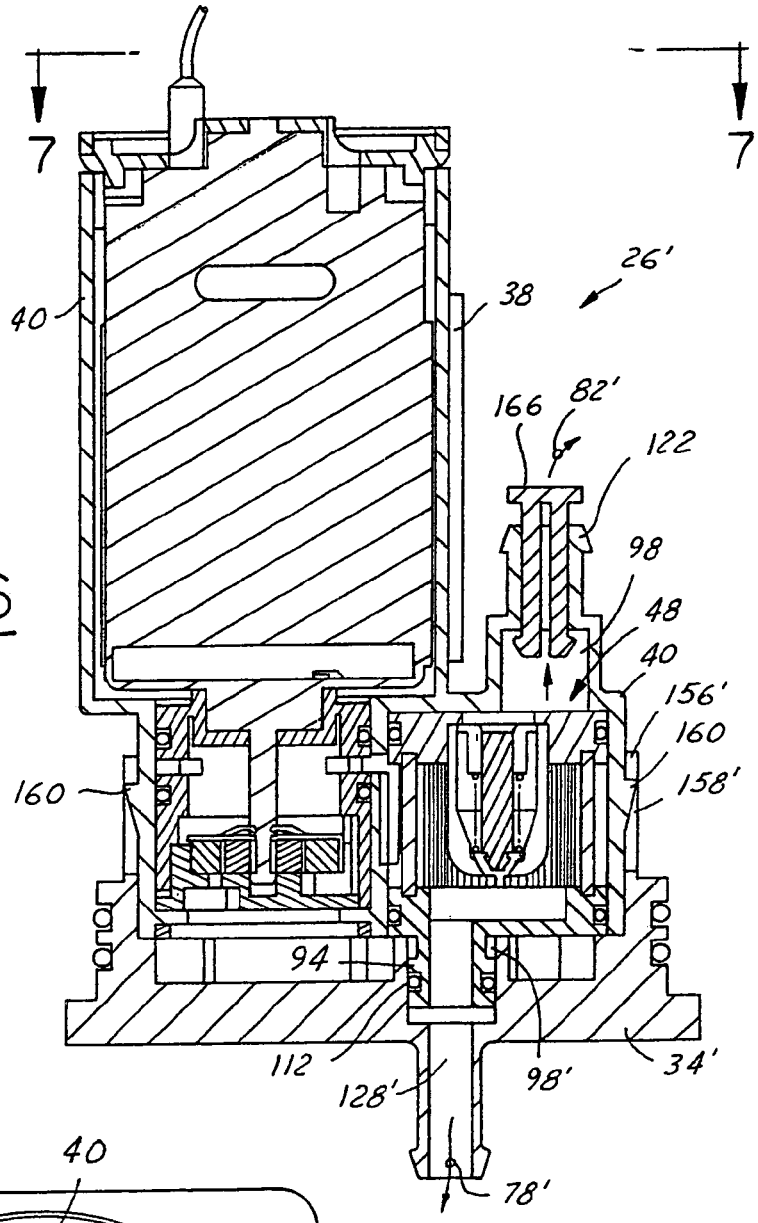
FIG. 6 is a cross section of the integrated fuel delivery system utilized in a fuel tank having a bottom access hole using aspects of the same fuel pump module for the top access hole.
Figure 7:
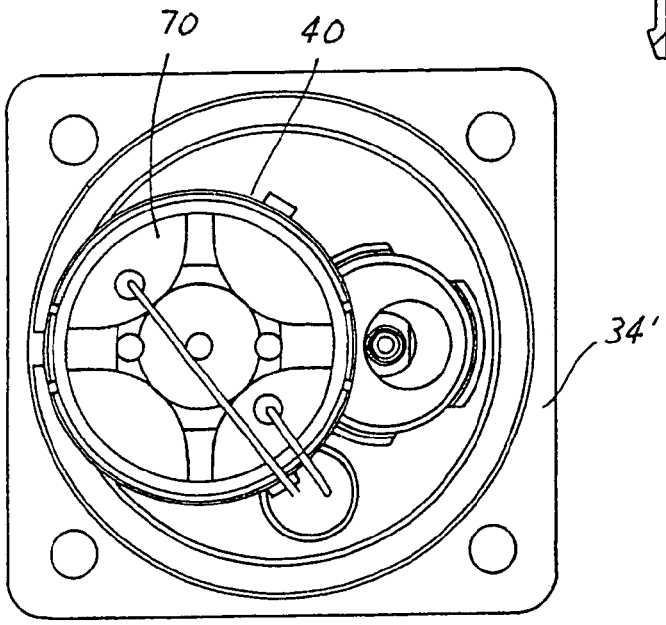
FIG. 7 is a top end view of the fuel pump module taken along line 7-7 of FIG. 6.

Referring to FIGS. 6-7, when the access hole (not shown) of the tank is in the bottom wall, a bottom flange 34' covers the hole. In this aspect of a fuel pump module 26', the support struts are not needed, thus the strut guides 38 of the pod 40 are not utilized. Moreover, the cover 42 is no longer utilized because the bottom flange 34' secures the filter cartridge 48 in place. Preferably, the same ramped tabs 160 of the pod 40 snap fit into slots 158' carried by upward extending arms 156' of the bottom flange 34'. Although not illustrated, the top and bottom flanges 34, 34' can be identical having features, such as the arms 156', which may or may not be utilized depending upon whether the tank access hole is in the top or bottom of the tank.

As previously described, the filter cartridge 48 is turned up-side-down so that the collar portion 94 and respective O-ring 112 are inserted into a counter bore 98' of the bottom flange 34' which communicates axially with, and is located generally concentrically to, the fuel outlet channel 128' of the bottom flange 34'. The supply fuel 78' exits out of the bottom of the second bore 62 and the bypass fuel 82' exits through the top of the second bore and through the counter bore 98 and nipple 122. A deflector 166 preferably snap fits into the nipple 122 to prevent fuel spray from exiting the tank if the tank fill cap happens to be removed, and to prevent disturbance of fuel flow into the fuel pump inlet filter (not shown).

Figure 8:
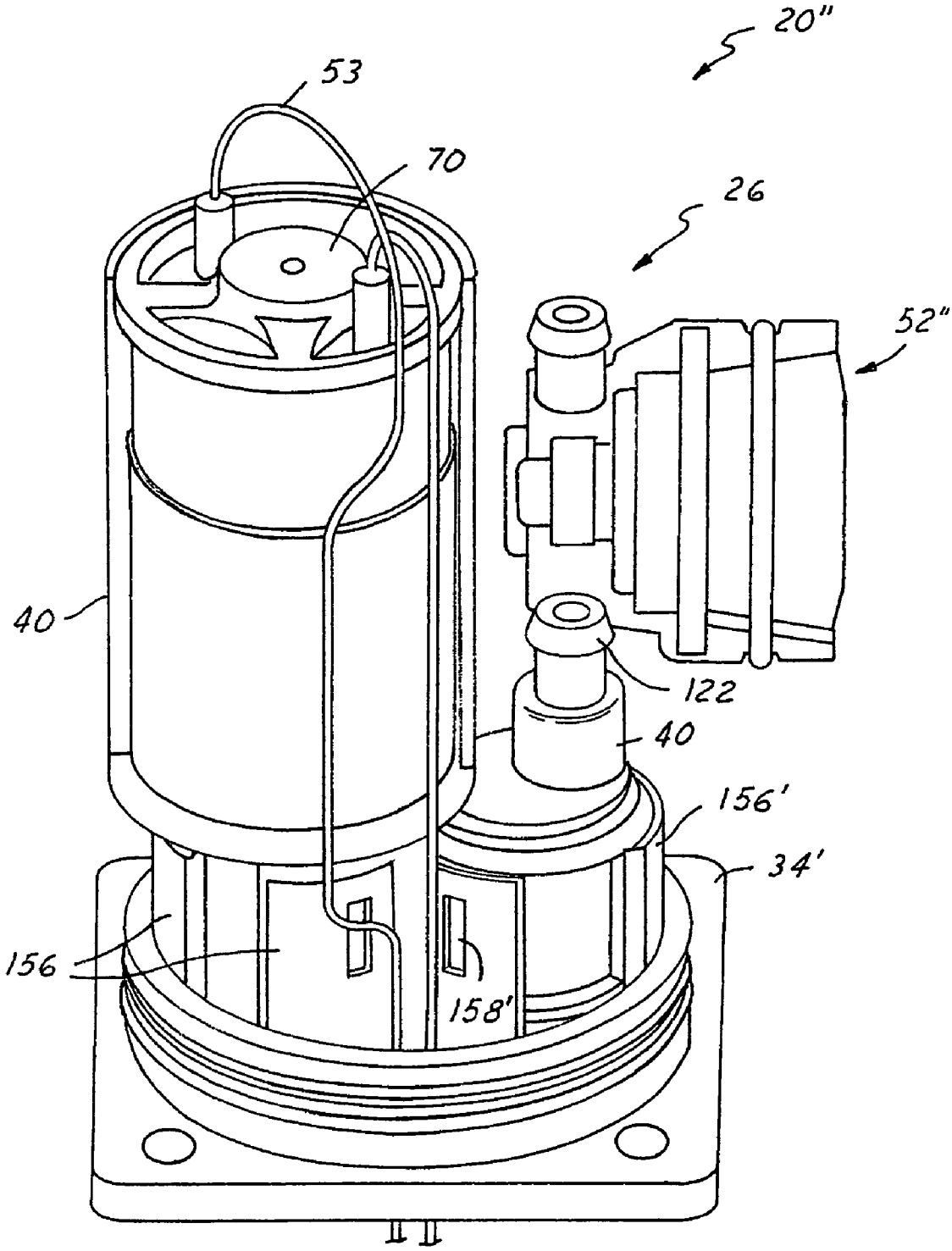
FIG. 8 is a perspective view of a modification of the integrated fuel delivery system with an externally mounted pressure regulator.

Referring to FIG. 8, another aspect of the bottom mounted fuel pump module 26" is illustrated having a pressure regulator 52" mounted externally from the previously described filter cartridge. In some fuel system applications this configuration may be preferred where regulators having unique or precise specifications are required. In this aspect, the head 138, shank 140, dome 132, guide 130 and spring 142 of the pressure regulator 52 are not assembled into the cartridge, however, the filter element 50 and end retainers 76, 80 are still utilized. The pressure regulator 52" is coupled to the nipple 122 which communicates with the pressure chamber 92.

While the forms of the invention herein disclosed constitute presently preferred embodiments, many others are possible. It is not intended herein to mention all the possibly equivalent forms or ramifications of the invention and it is understood that the terms used herein are merely descriptive rather than limiting and that various changes may be made without departing from the spirit or scope of the invention.

We claim:

1. A fuel pump module configured to be located inside of a fuel tank having a top access hole or a bottom access hole and supported by a flange comprising:

a flange covering the fuel tank access hole, and having a fuel outlet through the flange for supplying fuel to an engine;

a separate structural pod disposed in an upright position and constructed and arranged to be attached to the flange when the flange covers the access hole of the fuel tank;

a first bore defined by the pod and communicating axially downward to a radially inward projecting bottom shoulder defining a bottom fuel inlet when the flange covers the access hole of the fuel tank;

a fuel pump disposed in the first bore axially against the bottom shoulder and adjacent the bottom of the tank when the flange covers the access hole;

a second bore defined by the pod and spaced radially outward from the first bore;

a first fuel passage in the pod communicating between the first and second bores for flowing pressurized fuel from the fuel pump to the second bore;

a filter cartridge disposed in the second bore for filtering pressurized fuel from the first fuel passage;

a second fuel passage in the pod communicating with the second bore;

a third passage in the pod communicating with the second bore;

one of the second or third passages communicating with the filter cartridge for supplying filtered pressurized fuel to the fuel outlet in the flange and the other of the second or third passages communicating with the fuel tank for returning to the fuel tank any fuel by-passed from the pressurized fuel supplied to the fuel outlet in the flange;

a cylindrical filter element of the filter cartridge disposed concentrically in the second bore and spaced radially from the pod, the filter element having opposite circumferential ends;

a first annular retainer axially engaged sealably to one circumferential end and radially engaged sealably to the pod;

a second annular retainer axially engaged sealably to the opposite circumferential end and radially engaged sealably to the pod;

a continuous groove defined by the first retainer for seating the circumferential end of the filter element;

a continuous groove of the second retainer for seating the opposite circumferential end of the filter element;

an annular base segment of the second retainer having a central hole;

a dome segment of the second retainer fitted concentrically into the base segment, the dome segment inwardly defining a valve chamber and carrying a valve seat defining a bypass fuel aperture;

a guide segment of the second retainer fitted into the base segment and projecting radially inward into the valve chamber; and a biased closed valve head of the pressure regulator having a valve shank slidably supported by the guide segment in the valve chamber.

2. The fuel pump module set forth in claim 1 comprising:

an annular shelf of the enlarged valve head axially facing the guide segment; and a compression spring of the pressure regulator disposed about the valve shank and compressed between the guide segment and the annular shelf.

3. A fuel pump module for location inside a fuel tank having a top wall, and a bottom wall defining in part a fuel chamber for fuel for a combustion engine and a top access hole or a bottom access hole, the fuel pump module comprising:

a flange for covering the access hole of the fuel tank and a fuel outlet carried by the flange for supplying fuel to an engine;

a separate universal pod disposed in an upright position in the fuel tank and carried by the flange;

a first bore defined by the pod;

a fuel inlet carried by the pod, communicating the first bore adjacent the bottom of the first bore with the fuel tank adjacent the bottom of the fuel tank when the flange covers the access hole and is adjacent the top wail or the bottom wall of the fuel tank;

a fuel pump disposed in the first bore adjacent the bottom of the tank when the flange covers the access hole and is adjacent the top or bottom wall of the fuel tank and communicating with the fuel inlet for receiving fuel from the fuel tank;

a second bore defined by the pod, separate and spaced from the first bore and at one end opening through the pod for receiving a reversible filter cartridge and adjacent the other end of the second bore a fuel outlet;

a reversible annular filter cartridge received in the second bore and having generally axially spaced-apart and opposed primary and secondary end retainers, the primary end retainer being sealed with the second bore and having a primary outlet for flowing filtered fuel to the fuel outlet carried by the flange for supplying fuel to the combustion engine and the secondary end retainer being sealed with the second bore and having a secondary outlet for flowing bypass fuel back to the fuel chamber; and when the flange covers the access hole and is adjacent the top wall of the fuel tank, the reversible annular filter cartridge is in a first orientation in the second bore with its primary outlet communicating with the fuel outlet adjacent the other end of the second bore for flowing filtered fuel to the fuel outlet carried by the flange for supplying fuel to the engine and with its secondary outlet at least in part through the open end of the second bore communicating with the fuel chamber for flowing by-pass fuel to the fuel chamber of the tank, or when the flange covers the access hole and is adjacent the bottom wall of the fuel tank, the orientation of the filter cartridge is reversed to a second orientation in the second bore with its primary outlet adjacent the open end of the second bore and communicating with the fuel outlet carried by the flange for supplying fuel to the engine and its secondary outlet communicating with the fuel outlet adjacent the other end of the second bore for flowing by-pass fuel to the fuel chamber.

4. The fuel pump module set forth in claim 3 wherein the annular filter cartridge comprises a filter element disposed axially between the primary and secondary end retainers.

5. The fuel pump module set forth in claim 4 wherein the filter element is cylindrical and spaced radially inward from the second bore in the pod and the primary and secondary end retainers are substantially annular in shape.

6. An integrated fuel delivery system for a combustion engine comprising:

a fuel tank having top and bottom walls defining in part a fuel chamber and a top access hole through the top wall or a bottom access hole through the bottom wall;

a flange coupled sealably to the fuel tank and covering the access hole, the flange defining in part a fuel supply passage communicating through the flange and fuel tank for flow of supply fuel to the engine;

a universal pod supported by the flange, having separate first and second spaced-apart bores, and disposed in the fuel chamber;

a fuel pump located in the first bore of the universal pod and adjacent the bottom wall of the fuel tank when the flange covers the access hole and is adjacent the top or bottom wall;

the second bore opening at one end to the exterior of the universal pod, and a first fuel passage defined at least in part by the pod communicating the second bore adjacent the other end of the second bore with the exterior of the universal pod;

a filter cartridge removably slidably received at least in part in the second bore of the universal pod through the one end of the second bore;

a second fuel passage defined by the pod and communicating the first bore with the second bore for flowing pressurized fuel from the fuel pump and into the second bore;

an annular primary retainer of the filter cartridge engaged sealably to the pod in the second bore, the primary retainer having a hole for flowing filtered pressurized supply fuel through one of the ends of the second bore and out of the fuel tank;

an annular secondary retainer of the filter cartridge spaced axially away from the primary retainer and engaged sealably to the pod in the second bore, the secondary retainer having a hole for flowing filtered bypass fuel out of the other end of the second bore and back into the fuel tank chamber;

a filter element of the filter cartridge coupled sealably and axially between the primary and secondary retainers, wherein the filter element is disposed between the second fuel passage and the holes of the primary and secondary retainers; and when the flange covers the access hole and is adjacent the top wall, the hole of the primary retainer communicates with the first fuel passage for communicating the other end of the bore with the exterior of the pod or when the flange covers the access hole and is adjacent the bottom wall, the hole of the secondary retainer communicates with the first fuel passage through the other end of the second bore to the exterior of the universal pod.

7. The integrated fuel delivery system set forth in claim 6 comprising:

a bypass fuel vent defined by the pod for flowing limited, pressurized, bypass fuel from the pump and into the motor for cooling and lubrication.

8. The integrated fuel delivery system set forth in claim 6 wherein the second fuel passage communicates radially between the first and second bores.

9. The integrated fuel delivery system set forth in claim 6 wherein the first fuel passage comprises a third bore defined by the pod and extending generally parallel to the axis of the second bore; and an axially projecting collar portion of the primary retainer engaged sealably in the third bore when the access hole is located in the tank top and engaged sealably to the flange when the flange covers the access hole and is located adjacent the tank top or is engaged sealably to the flange when the flange covers the access hole and is located adjacent the tank bottom.

10. The integrated fuel delivery system set forth in claim 6 comprising the fuel filter element being annular and having opposite ends engaged sealably to the respective primary and secondary retainers.

11. The integrated fuel delivery system set forth in claim 6 comprising:

a bottom cover covering the second bore and engaged to the universal pod when the flange covers the access hole and is located adjacent the fuel tank top; and a hole of the bottom cover communicating with the hole of the secondary retainer for flowing bypass fuel back into the fuel chamber.

12. The integrated fuel delivery system set forth in claim 11 comprising: a plurality of ramped tabs projecting unitarily outward from the universal pod; and a plurality of flexible arms of the bottom cover each having a slot for a snap fit to the ramped tabs when the flange covers the access hole and is adjacent the top of the tanks.

13. The integrated fuel delivery system set forth in claim 12 comprising at least one strut coupled between the flange and the pod.

14. The integrated fuel delivery system set forth in claim 9 comprising:

a fuel supply tube connecting the first fuel supply passage of the pod with the fuel supply passage of the flange for flowing supply fuel out of the tank when the flange covers the access hole and is adjacent the top of the tank.

15. The integrated fuel delivery system set forth in claim 14 comprising:

a deflector fitted to the fuel first supply passage of the pod for controlling bypass fuel spray when the flange covers the access hole and is located adjacent the bottom of the tank.

16. The fuel pump module set forth in claim 3 comprising a pressure regulator in the second bore and at least in part received within the filter cartridge and communicating with the primary outlet of the filter cartridge for controlling fuel pressure of the filtered fuel supplied to the fuel outlet of the flange and when the flange is adjacent the top wall of the fuel tank bypasses fuel to the fuel chamber through the open end of the second bore or when the flange is adjacent the bottom wall of the fuel tank bypasses fuel to the fuel chamber through the other end of the second bore.

17. A fuel pump module for location inside of a fuel tank having a top wall, a bottom wall, and a top access hole or a bottom access hole comprising:

a flange covering the access hole of the fuel tank and having a fuel outlet through the flange for supplying fuel to an engine;

a separate structural pod carried by the flange and constructed and arranged to be in an upright position when the flange covers the access hole of the fuel tank;

a first bore defined by the pod and communicating with the fuel tank adjacent the bottom of the fuel tank when the flange covers the access hole and is adjacent the top wall or the bottom wall of the fuel tank;

a fuel pump received in the first bore and carried by the pod with a fuel inlet adjacent the bottom of the tank when the flange covers the access hole and is adjacent the top wall or the bottom wall of the fuel tank;

a second bore defined by the pod, separate and spaced from the first bore defined by the pod, and at one end opening through the pod for receiving a reversible fuel filter and adjacent the other end of the second bore a fuel outlet;

a reversible annular filter cartridge received in the second bore and having generally axially spaced apart and opposed primary and secondary end retainers, the primary end retainer having a primary outlet for supplying filtered fuel to the fuel outlet carried by the flange for supplying fuel to the combustion engine and the secondary end retainer having a secondary outlet for flowing bypass fuel to the fuel chamber of the fuel tank; and when the flange is adjacent the top wall of the fuel tank and covers the access hole, the filter cartridge is in a first orientation in the second bore with its primary outlet communicating with the fuel outlet adjacent the other end of the second bore for supplying filtered fuel to the fuel outlet carried by the flange for supplying fuel to the engine and with its secondary outlet communicating at least in part through the open end of the second bore with the fuel chamber for returning bypass fuel to the fuel chamber of the fuel tank, or when the flange is adjacent the bottom wall of the fuel tank and covers the access hole, the filter cartridge is reversed to a second orientation in the second bore with its primary outlet adjacent the open end of the second bore and communicating with the fuel outlet carried by the flange for supplying fuel to the engine and with its secondary outlet adjacent the other end of the second bore for returning bypass fuel to the fuel chamber of the fuel tank.

* * * * *